US006929042B2

(12) United States Patent
Chang

(10) Patent No.: US 6,929,042 B2
(45) Date of Patent: Aug. 16, 2005

(54) SEMI-AUTOMATIC MORTISING MACHINE

(76) Inventor: Chi-Lo Chang, 122-5, Jun Laio Rd., Feng Yuan, Taichung Hsien (TW)

( * ) Notice: Subject to any disclaimer, the term of this patent is extended or adjusted under 35 U.S.C. 154(b) by 27 days.

(21) Appl. No.: 10/634,185

(22) Filed: Jul. 30, 2003

(65) Prior Publication Data

US 2005/0022899 A1 Feb. 3, 2005

(51) Int. Cl.[7] ..... B27F 5/02; B27C 5/06
(52) U.S. Cl. ..... 144/71; 144/144.1; 144/145.1
(58) Field of Search ..... 144/69–41, 74, 144/82–85, 87, 368, 371, 372, 144.1, 144.51, 145.1, 145.2

(56) References Cited

U.S. PATENT DOCUMENTS 1,698,827 A * 1/1929 Skolnik ..... 144/70
2,586,798 A * 2/1952 Eck ..... 144/87
2,747,627 A * 5/1956 Havlik ..... 144/85
3,272,244 A * 9/1966 Nemec ..... 144/87
3,834,435 A * 9/1974 McCord, Jr. ..... 144/144.51

* cited by examiner

*Primary Examiner*—Derris H. Banks
*Assistant Examiner*—Shelley Self
(74) *Attorney, Agent, or Firm*—Alan D. Kamrath; Nikolai & Mersereau, P.A.

(57) ABSTRACT

A semi-automatic mortising machine includes a support base, a support bar, a guide device, a working device, a distance adjusting device, and a dust collection box. Thus, the displacement direction can be controlled in a manual manner during the working process, and the cutting operation is performed in an automatic manner, so as to cut the mortises and tenons in the workpiece.

9 Claims, 9 Drawing Sheets

SEMI-AUTOMATIC MORTISING MACHINE

BACKGROUND OF THE INVENTION

1. Field of the Invention

The present invention relates to a semi-automatic mortising machine, and more particularly to a semi-automatic mortising machine that can co-operate with a manual working manner to form the mortises and tenons in the workpiece.

2. Description of the Related Art

Referring to FIG. 1, a wood material 1 is formed with a plurality of mortises 11 or a plurality of tenons 12 in a manual manner or by an automatic working process. The manual working manner of the wood material 1 has a very poor working speed, thereby decreasing the working efficiency and increasing costs of production. The automatic working process of the wood material 1 greatly increases the working speed. However, the conventional automatic mortising machine need to have the multi-axial displacement feature so as to match the profiles of the mortises and tenons of the workpiece, so that the conventional automatic mortising machine has a complicated construction, thereby increasing costs of fabrication and maintenance.

SUMMARY OF THE INVENTION

The primary objective of the present invention is to provide a semi-automatic mortising machine, wherein the displacement direction can be controlled in a manual manner during the working process, and the cutting operation is performed in an automatic manner, so as to cut the mortises and tenons in the workpiece.

Another objective of the present invention is to provide a semi-automatic mortising machine, wherein the construction of the semi-automatic mortising machine is largely simplified.

A further objective of the present invention is to provide a semi-automatic mortising machine that can reduce the possibility of malfunction.

A further objective of the present invention is to provide a semi-automatic mortising machine that can facilitate maintenance.

A further objective of the present invention is to provide a semi-automatic mortising machine that can maintain the quality of the products.

In accordance with the present invention, there is provided a semi-automatic mortising machine, comprising:

a support base including two side walls arranged in the X-axis direction, and at least one platform mounted between the two side walls for placing at least one workpiece;

a support bar mounted on the support base in parallel with the X-axis direction and having at least one side face formed with a plurality of tenons which are arranged in parallel with the X-axis direction;

a guide device mounted between the platform of the support base and the support bar and operated in a manual manner to displace in parallel with the X-axis direction and in parallel with the Y-axis direction according to the profile of the tenons of the support bar; and a working device moved with the guide device, and including a blade extended downward in the Z-axis direction to contact the workpiece, so that the blade can cut mortises and tenons in the workpiece according to the profile and distance of the tenons of the support bar.

Further benefits and advantages of the present invention will become apparent after a careful reading of the detailed description with appropriate reference to the accompanying drawings.

DETAILED DESCRIPTION OF THE INVENTION

Figure 1:
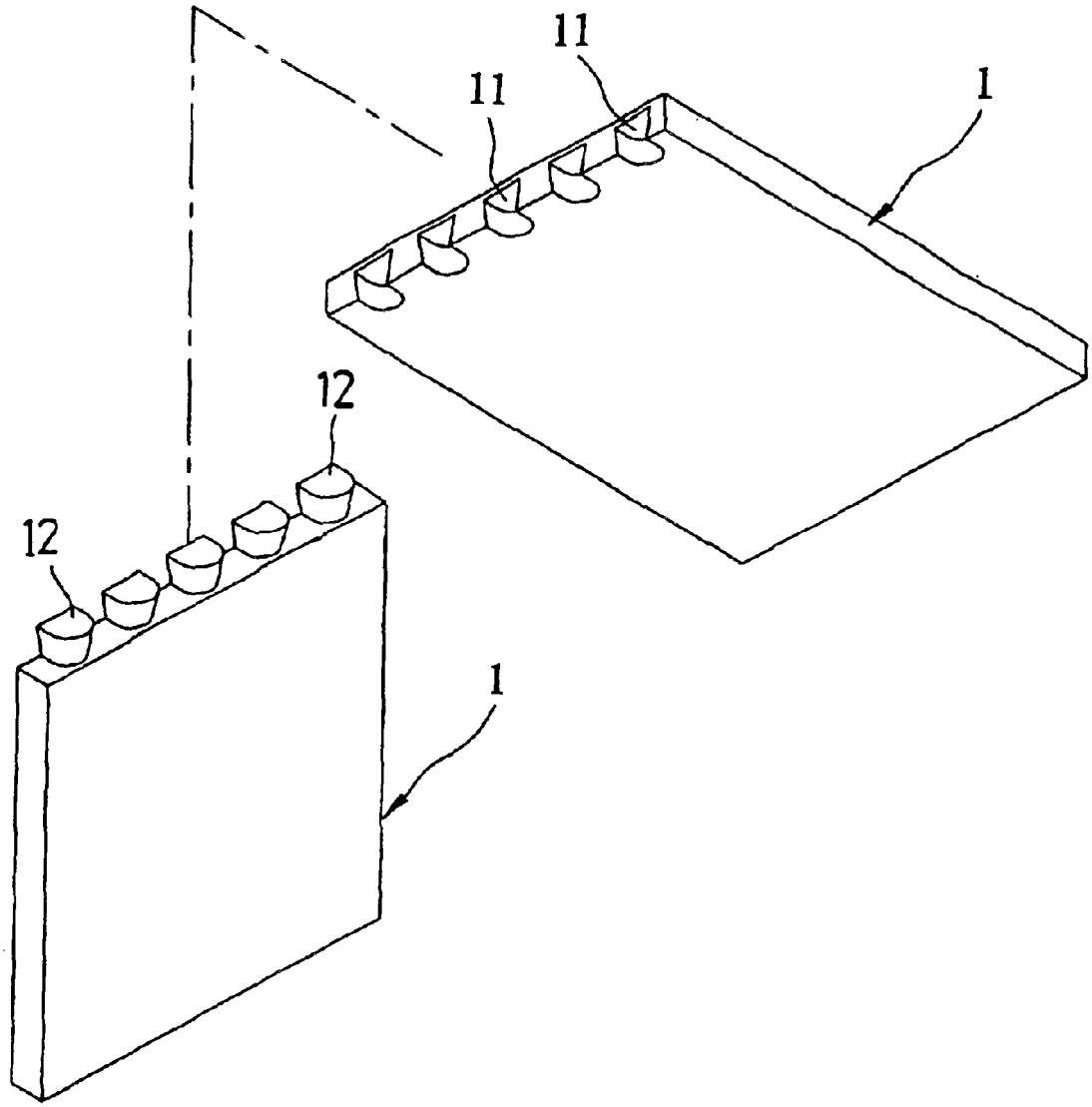
F I G. 1 PRIOR ART
FIG. 1 is a perspective view showing a workpiece being worked by a conventional semi-automatic mortising machine in accordance with the prior art.
Figure 2:
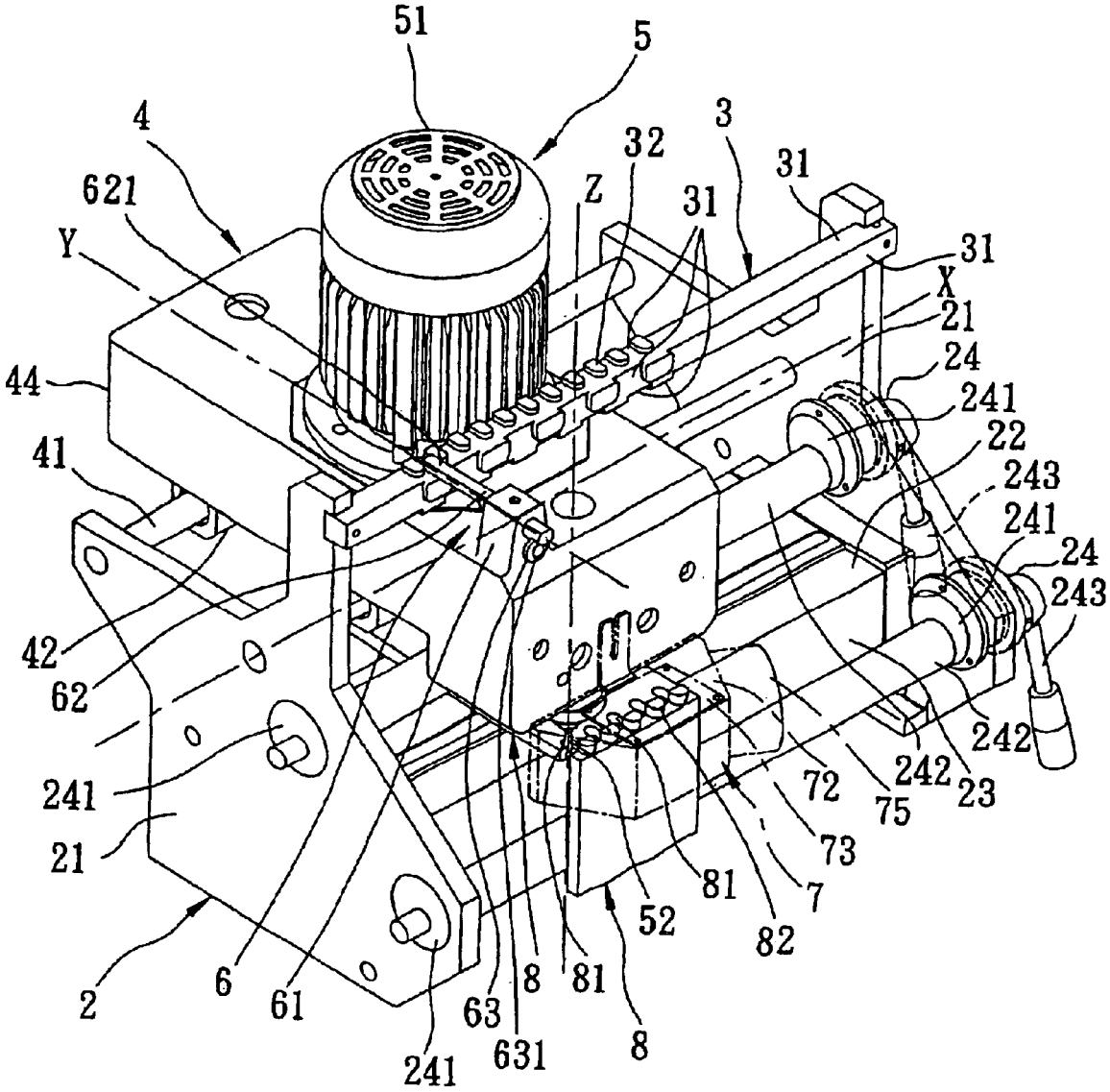
FIG. 2 is a perspective view of a semi-automatic mortising machine in accordance with the preferred embodiment of the present invention.
Figure 3:
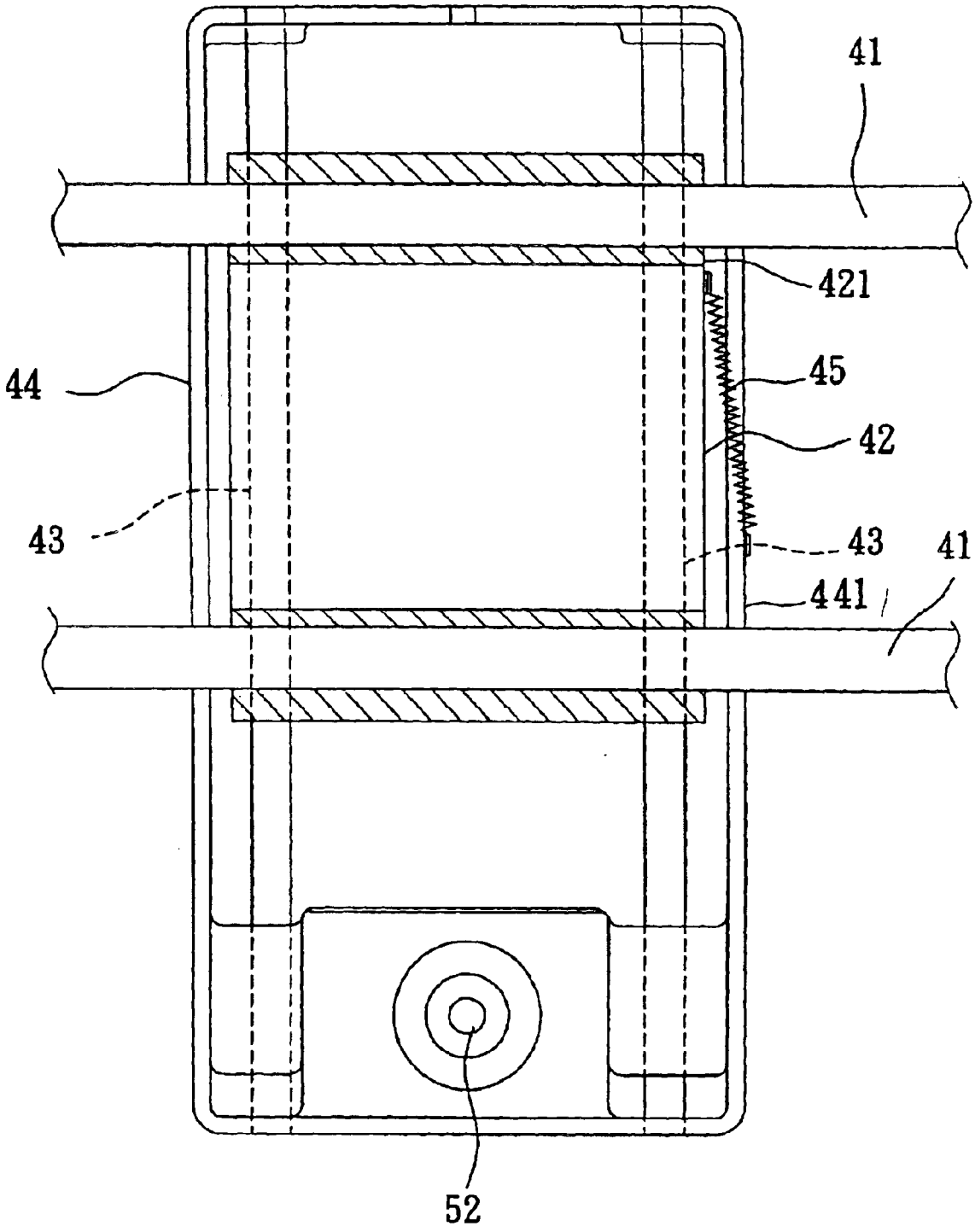
FIG. 3 is a partially cut-away bottom plan cross-sectional view of the semi-automatic mortising machine as shown in FIG. 2.

Referring to the drawings and initially to FIGS. 2–5, a semi-automatic mortising machine in accordance with the preferred embodiment of the present invention comprises a support base 2, a support bar 3, a guide device 4, a working device 5, a distance adjusting device 6, and a dust collection box 7.

The support base 2 includes two side walls 21 arranged in the X-axis direction, two adjacent platforms 22 and 23 mounted between the two side walls 21 and each extended toward the horizontal face and the vertical face respectively, and two positioning members 24. Thus, two workpieces 8 are placed on the two adjacent platforms 22 and 23 in the horizontal direction and the vertical direction respectively, and are located adjacent to each other.

Each of the two positioning members 24 includes two rotation disks 241 rotatably mounted between the two side walls 21 of the support base 2, a positioning rod 242 eccentrically mounted between the two rotation disks 241, and a drive handle 243 mounted on one of the two rotation disks 241 for rotating the rotation disk 241, so that the positioning rod 242 can be moved toward or away from the two adjacent platforms 22 and 23 during rotation of the two rotation disks 241, so as to press the two workpieces 8 on the two adjacent platforms 22 and 23 or to release the two workpieces 8 from the two adjacent platforms 22 and 23.

The support bar 3 is mounted between the two side walls 21 of the support base 2 and located above the platform 22. The support bar 3 has four side faces 31 each formed with a plurality of tenons 32 which are arranged in parallel with the X-axis direction.

The guide device 4 includes two axial displacement rods 41 each mounted between the two side walls 21 of the support base 2, a slide seat 42 slidably mounted on the two axial displacement rods 41 to move in parallel with the X-axis direction, two radial displacement rods 43 each extended through the slide seat 42 to move in parallel with the Y-axis direction, a slide box 44 fixed on the two radial displacement rods 43 to move therewith, and an elastic member 45 mounted between a side 421 of the slide seat 42 and a side 441 of the slide box 44, so that the slide box 44 is constantly moved toward the support bar 3. Preferably, the elastic member 45 is a spring.

The working device 5 includes a motor 51 mounted on the slide box 44, and a blade 52 extended downward in the Z-axis direction. The blade 52 is connected to a reduction mechanism (not shown) which is mounted in the slide box 44 and connected to the motor 51, so that the blade 52 is driven by the motor 51.

The distance adjusting device 6 includes a support rack 61 mounted on a top face of the slide box 44 and directed toward the support bar 3, a molding bar 62 extended through the support rack 61 and in parallel with the Y-axis direction, and a threaded rod 63 screwed on the support rack 61 and in parallel with the Y-axis direction. The molding bar 62 has a first end formed with a molding end 621 rested on the support bar 3 and a second end formed with a locking end 623 formed with a locking groove 622. The threaded rod 63 has a bolt head 631 locked in the locking groove 622 of the molding bar 62. Thus, the threaded rod 63 is moved relative to the support rack 61 to move the molding bar 62 so as to adjust the distance of the molding end 621 of the molding bar 62 and the support bar 3.

Figure 4:
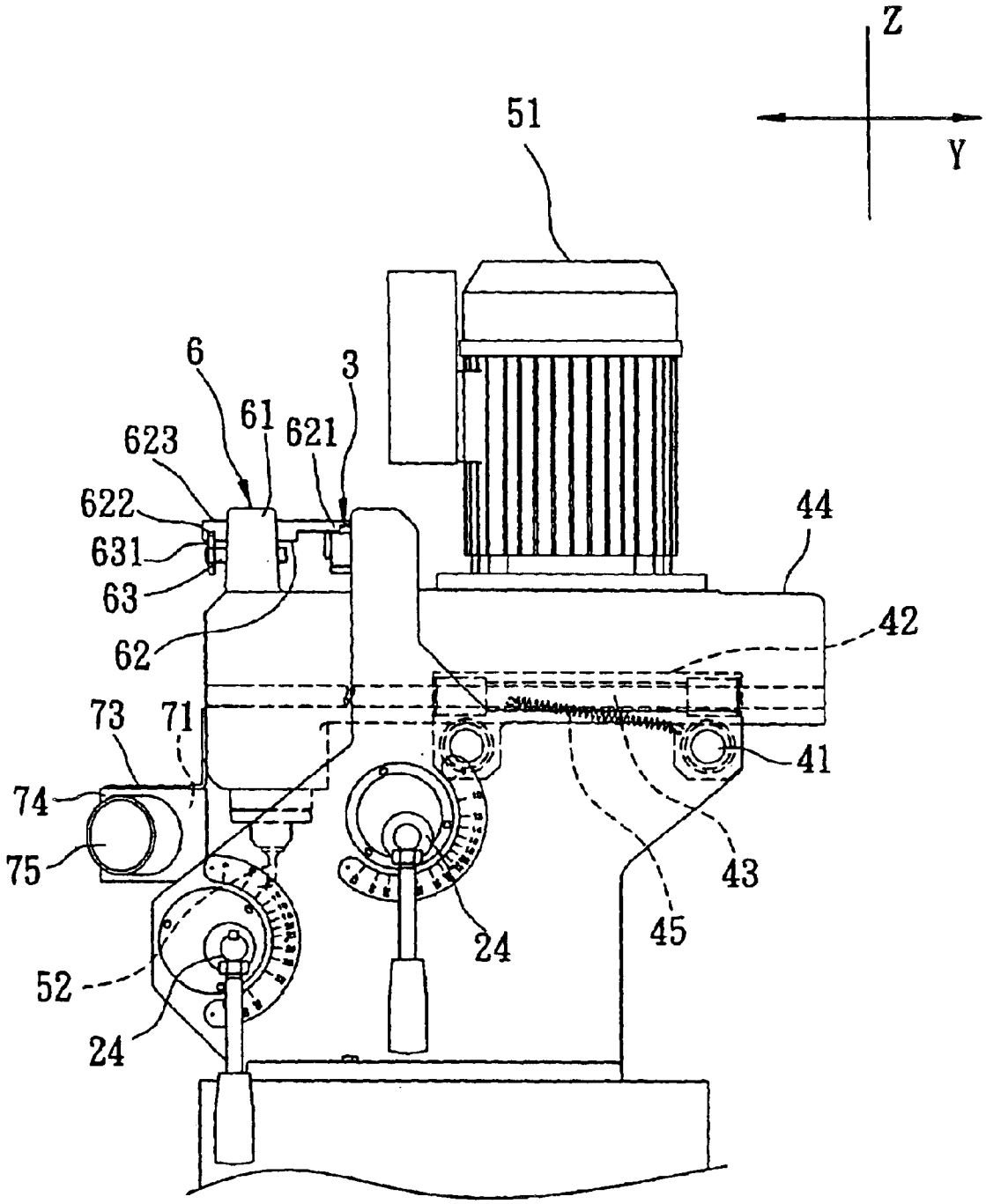
FIG. 4 is a partially cut-away side plan view of the semi-automatic mortising machine as shown in FIG. 2.
Figure 5:
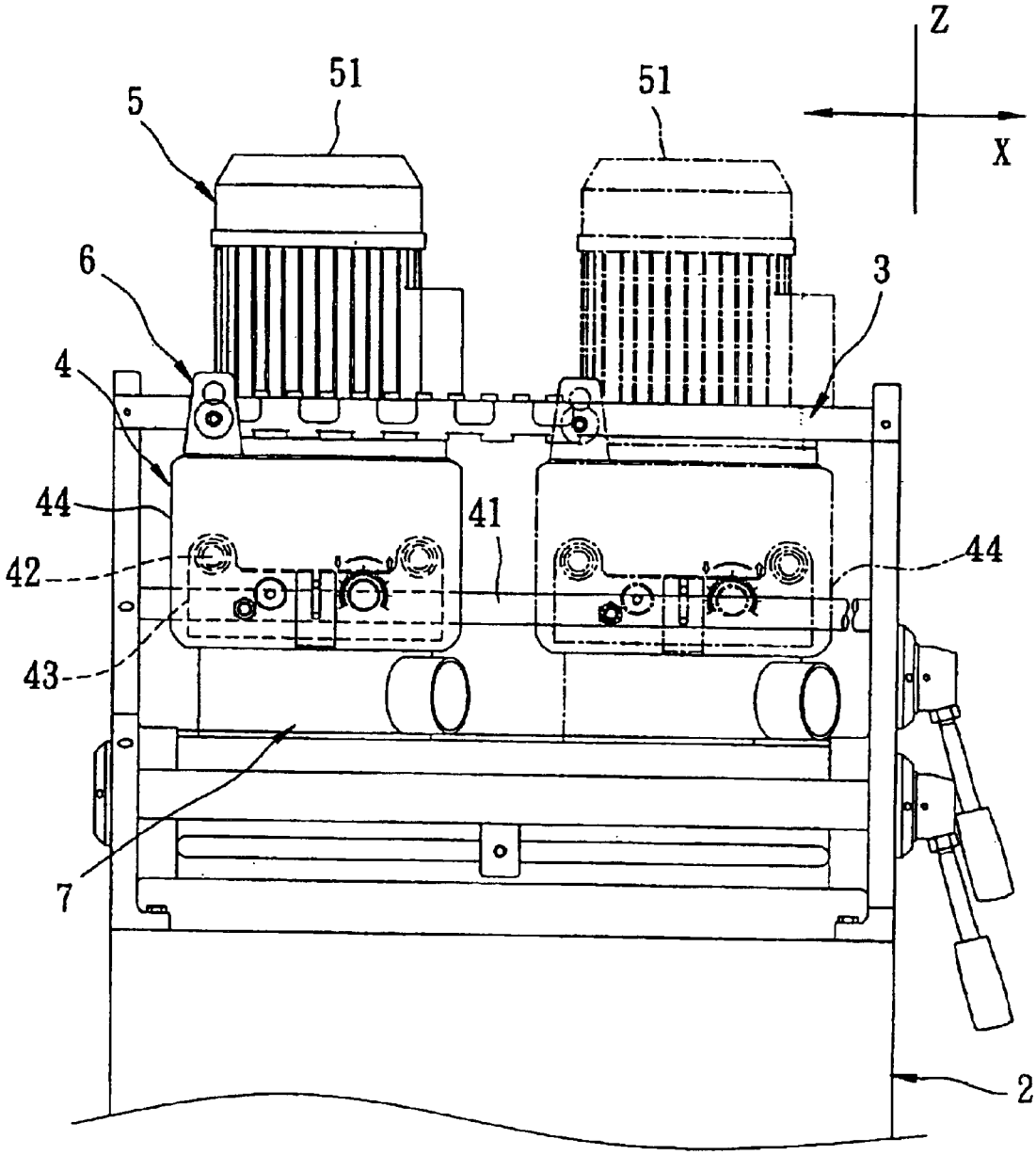
FIG. 5 is a partially cut-away front plan operational view of the semi-automatic mortising machine as shown in FIG. 2.

The dust collection box 7 is secured on the slide box 44, and has an inside formed with opening 71 in parallel with the Y-axis direction and directed toward the blade 52 as shown in FIG. 4, a top face 72 provided with a transparent window 73, and a side 74 formed with a chip drain hole 75 which is connected to a dust cleaning device (not shown), so that the powdered chips produced from the workpiece 8 can enter the dust collection box 7 through the opening 71 and can be drained outward from the chip drain hole 75. Thus, the operator can inspect the chip drainage condition of the dust collection box 7 through the transparent window 73.

In operation, the motor 51 drives the blade 52 to rotate. Thus, the slide box 44 can be pushed or pulled in a manual manner, so that the slide box 44 and the slide seat 42 can slide on the axial displacement rods 41 to move in parallel with the X-axis direction, or the slide box 44 and the radial displacement rods 43 can slide on the slide seat 42 to move in parallel with the Y-axis direction. Thus, the slide box 44 can moved in parallel with the X-axis direction and in parallel with the Y-axis direction arbitrarily.

Thus, the molding bar 62 is moved with the slide box 44 to displace in parallel with the X-axis direction and in parallel with the Y-axis direction arbitrarily, so that the molding end 621 of the molding bar 62 can be moved along the periphery of each of the tenons 32 of the support bar 3. Thus, the slide box 44 can be moved along the track of the molding end 621 of the molding bar 62 to drive the blade 52 to move along the track of the molding end 621 of the molding bar 62 so as to cut mortises 81 and tenons 82 in the workpiece 8 according to the profile and distance of the tenons 32 of the support bar 3, so that the mortises 81 and tenons 82 of the workpiece 8 can match the relative profile and distance of the respective tenons 32 of the support bar 3.

In addition, the slide box 44 is constantly moved toward the support bar 3 by the elastic force of the elastic member 45, to prevent the molding end 621 of the molding bar 62 from detaching from the support bar 3, so that the molding end 621 of the molding bar 62 can align with the corresponding working position of the support bar 3 easily and conveniently.

Further, the four side faces 31 of the support bar 3 are provided with tenons 32 of different forms and distance, so that the molding end 621 of the molding bar 62 can be moved along the tenons 32 of different side faces 31 of the support bar 3 so as to cut mortises 81 and tenons 82 of different forms and distance.

Figure 6:
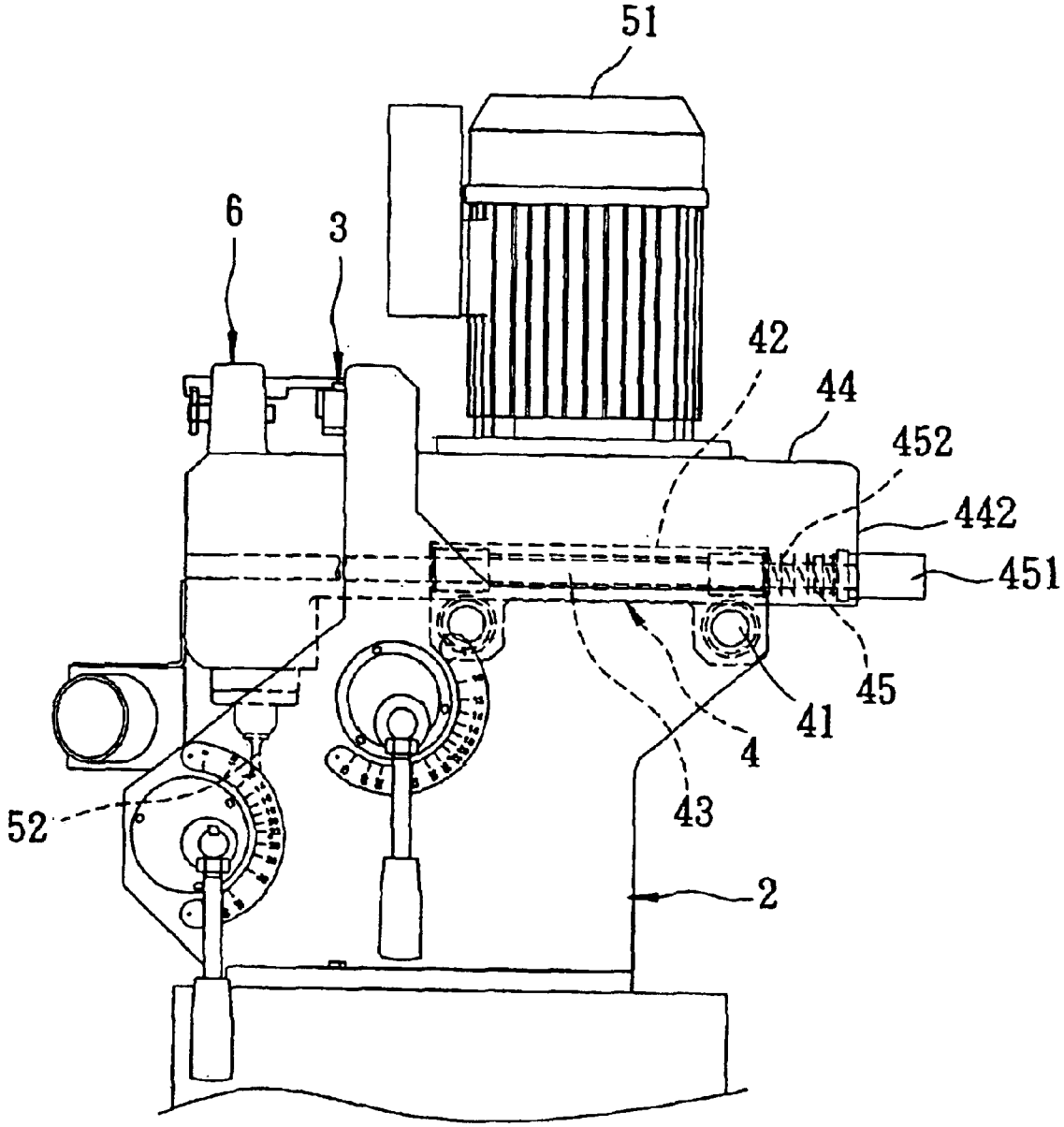
FIG. 6 is a partially cut-away side plan view of the semi-automatic mortising machine in accordance with another embodiment of the present invention.

Referring to FIG. 6, the elastic member 45 includes a bolt 451 screwed through a rear wall 442 of the slide box 44 along the Y-axis direction, and a compression spring 452 urged between the bolt 451 and the slide seat 42. Thus, the compression spring 452 can push the slide box 44 backward along the Y-axis direction, so that the slide box 44 is constantly moved toward the support bar 3.

Figure 7:
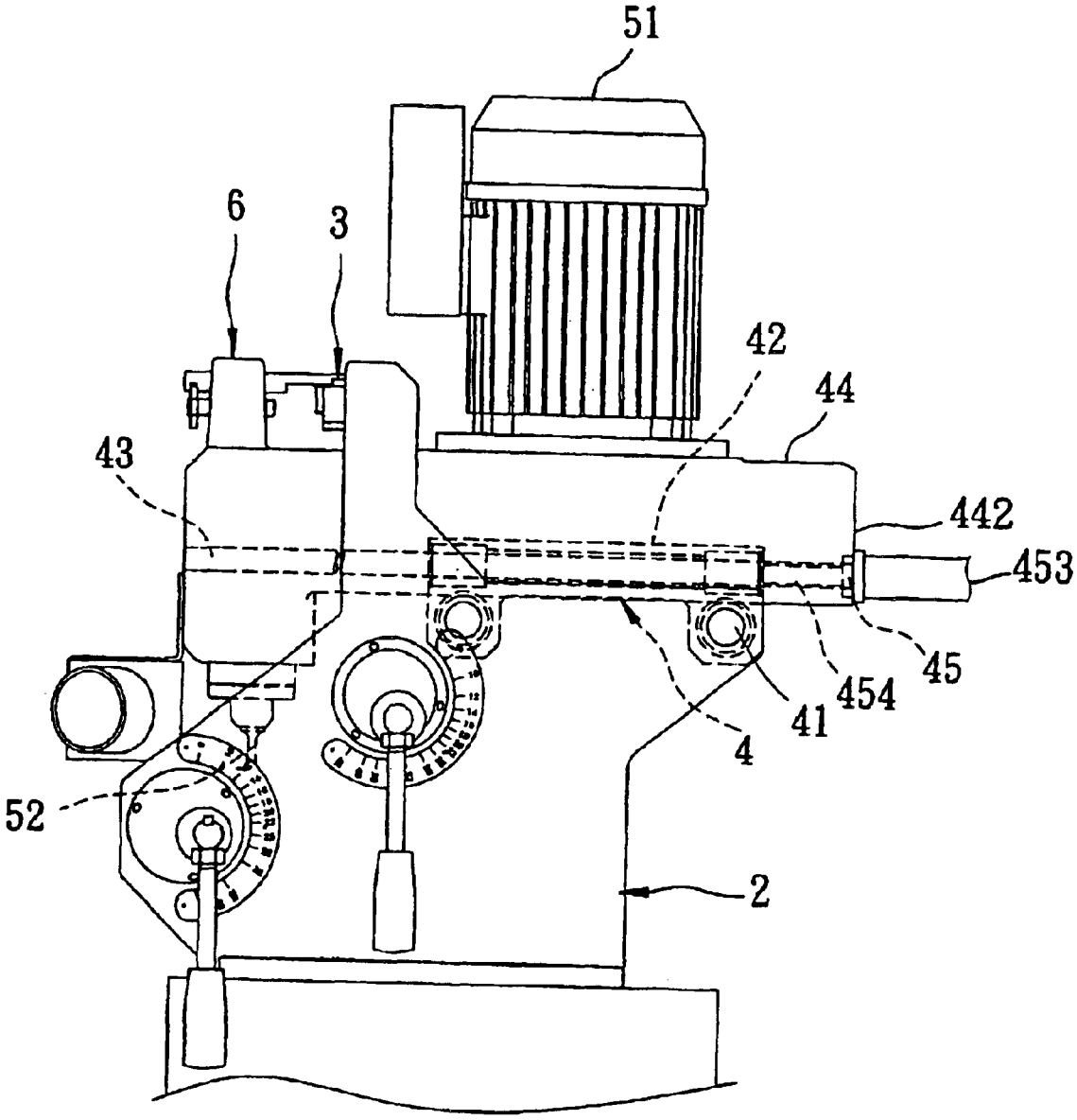
FIG. 7 is a partially cut-away side plan view of the semi-automatic mortising machine in accordance with another embodiment of the present invention.

Referring to FIG. 7, the elastic member 45 includes a press cylinder 453 extended through the rear wall 442 of the slide box 44 along the Y-axis direction, and a piston rod 454 secured on the slide seat 42 and retractably mounted on the press cylinder 453. Thus, the piston rod 454 can be retracted to drive the slide box 44 to move backward along the Y-axis direction, so that the slide box 44 is constantly moved toward the support bar 3.

Figure 8:
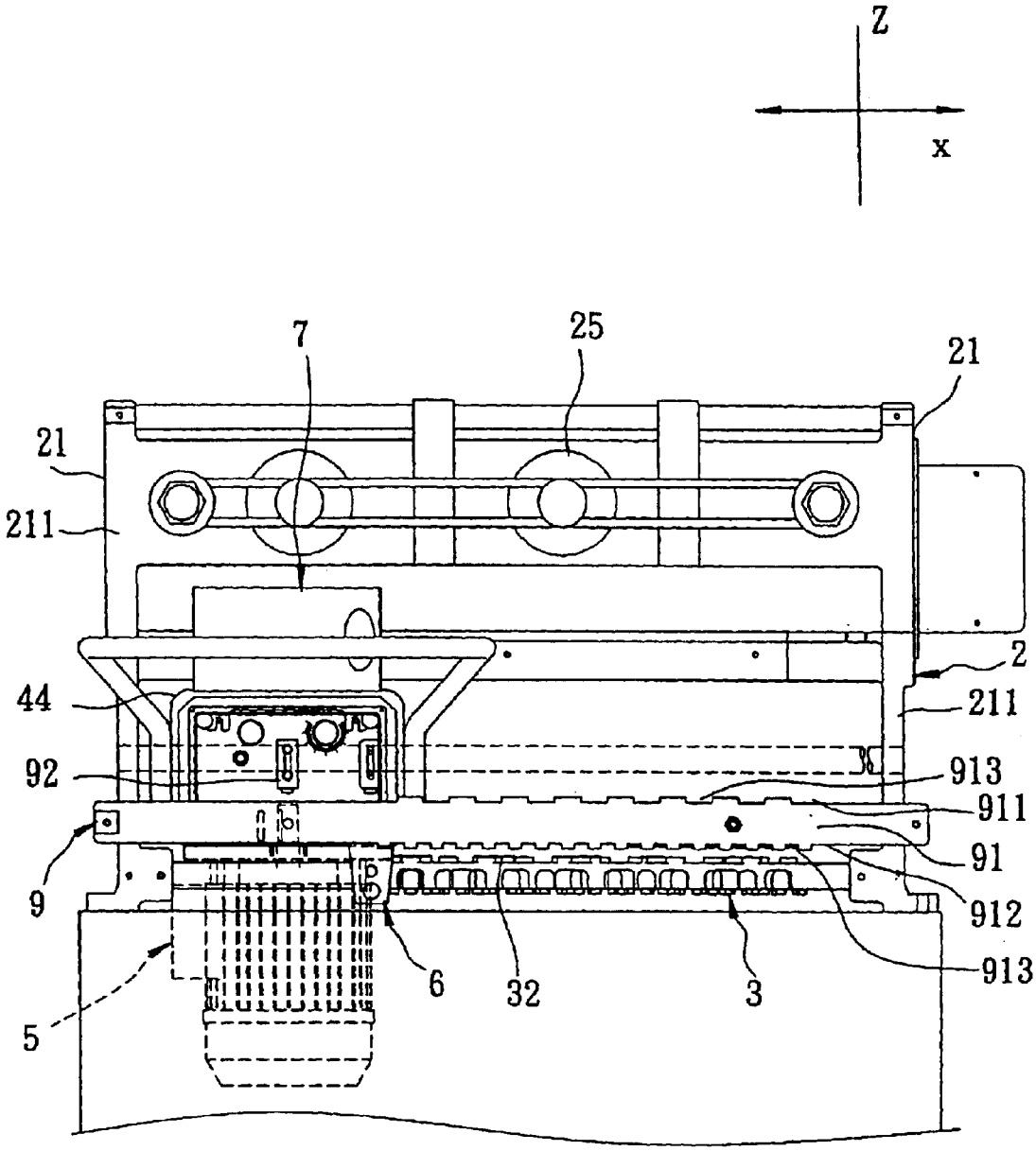
FIG. 8 is a partially cut-away front plan view of the semi-automatic mortising machine in accordance with another embodiment of the present invention.
Figure 9:
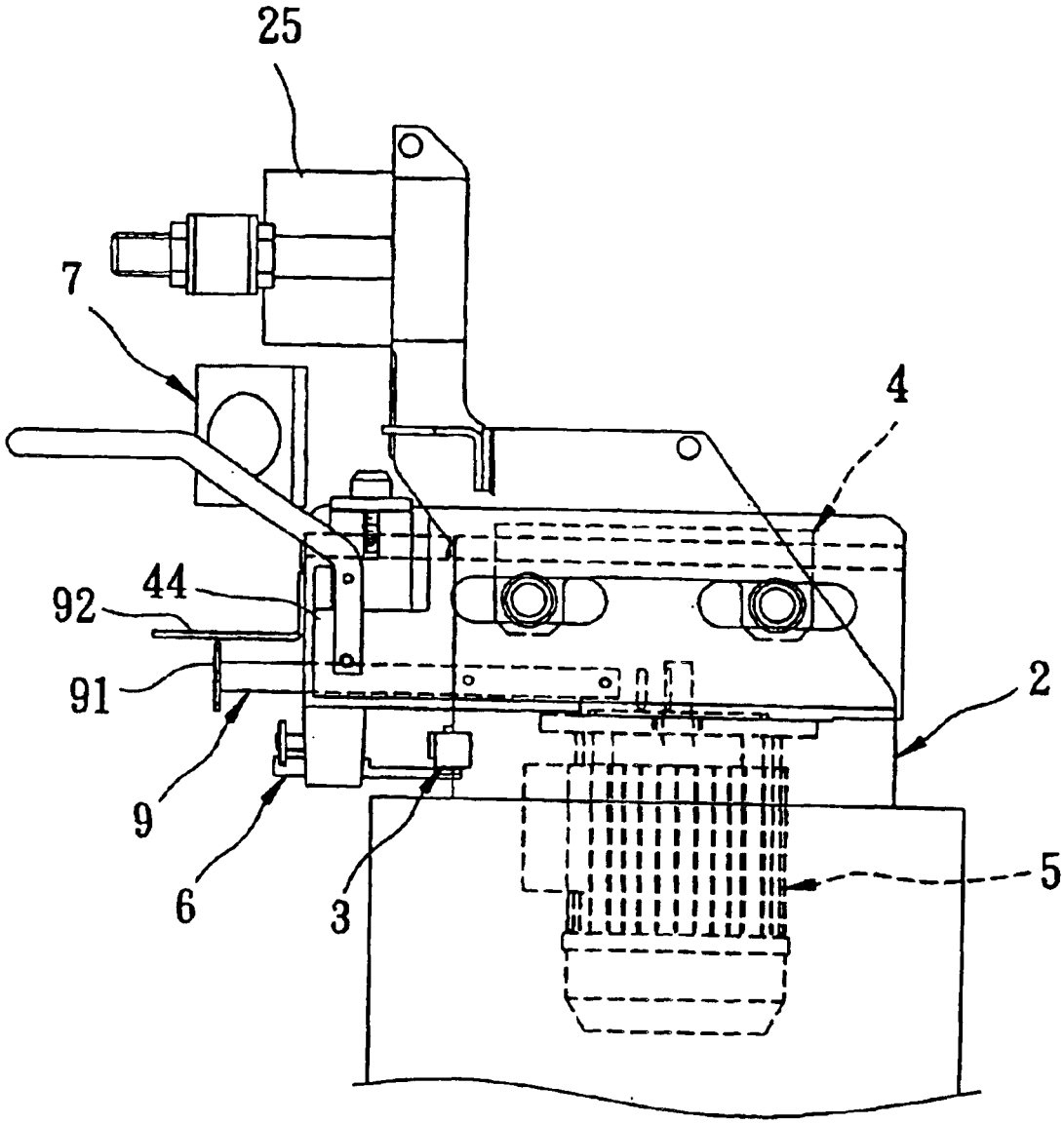
FIG. 9 is a side plan view of the semi-automatic mortising machine as shown in FIG. 8.

Referring to FIGS. 8 and 9, the semi-automatic mortising machine in accordance with another embodiment of the present invention further comprises an indication device 9.

The support base 2 includes a plurality of press cylinders 25 for pressing the workpieces 8. The support bar 3 is located under the platforms 22 and 23. The distance adjusting device 6 is mounted on a bottom face of the slide box 44. Thus, the distance adjusting device 6 can drive the working device 5 to cut the mortises 81 and tenons 82 in the workpiece 8 according to the profile and distance of the tenons 32 of the support bar 3, so that the mortises 81 and tenons 82 of the workpiece 8 can match the relative profile and distance of the respective tenons 32 of the support bar 3.

The indication device 9 includes an indication bar 91 secured on a front end 211 of the side wall 21 of the support base 2, and a direction bar 92 secured on the slide box 44 and located above the indication bar 91. The indication bar 91 has a top face 911 and a bottom face 912 each formed with a plurality of recesses 913 whose spaced distance is equal to that of the tenons 32 of the support bar 3. Thus, when the slide box 44 is moved along the track of the tenons 32 of the support bar 3, the direction bar 92 is moved with the slide box 44 in the X-axis direction, so that the direction bar 92 can align the position of each of the mortises 81 and tenons 82 of the workpiece 8 with that of the respective recess 913 of the indication bar 91, so as to indicate the working condition of the workpiece 8 by the indication bar 91.

Accordingly, the semi-automatic mortising machine in accordance with the present invention has the following advantages.

The displacement direction can be controlled in a manual manner during the working process, and the cutting operation is performed in an automatic manner, so as to cut the mortises 81 and tenons 82 in the workpiece 8. Thus, the construction of the semi-automatic mortising machine is largely simplified. In addition, the semi-automatic mortising machine can reduce the possibility of malfunction. Further, the semi-automatic mortising machine can facilitate maintenance. Further, the semi-automatic mortising machine can maintain the quality of the products.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A semi-automatic mortising machine, comprising:

a support base including two side walls arranged in the X-axis direction, and at least one platform mounted between the two side walls for placing at least one workpiece;

a support bar mounted on the support base in parallel with the X-axis direction and having at least one side face formed with a plurality of tenons which are arranged in parallel with the X-axis direction;

a guide device mounted between the platform of the support base and the support bar and operated in a manual manner to displace in parallel with the X-axis direction and in parallel with the Y-axis direction according to a profile of the tenons of the support bar; and a working device moved with the guide device, and including a blade extended downward in the Z-axis direction to contact the workpiece, so that the blade can cut mortises and tenons in the workpiece according to the profile and distance of the tenons of the support bar;

wherein the support base further includes at least one positioning member including two rotation disks rotatably mounted between the two side walls of the support base, a positioning rod eccentrically mounted between the two rotation disks, and a drive handle mounted on one of the two rotation disks for rotating the rotation disks, so that the positioning rod is selectively moved toward or away from the platform during rotation of the two rotation disks to selectively press the workpiece on the platform or to release the workpiece from the platform.

2. The semi-automatic mortising machine in accordance with claim 1, wherein the support base includes two adjacent platforms.

3. The semi-automatic mortising machine in accordance with claim 1, wherein the support bar has a multi-angular cross-section and has a plurality of adjacent side faces each formed with a plurality of tenons which are spaced with a different distance on different side faces.

4. A semi-automatic mortising machine, comprising:

a support base including two side walls arranged in the X-axis direction, and at least one platform mounted between the two side walls for placing at least one workpiece;

a support bar mounted on the support base in parallel with the X-axis direction and having at least one side face formed with a plurality of tenons which are arranged in parallel with the X-axis direction:

a guide device mounted between the platform of the support base and the support bar and operated in a manual manner to displace in parallel with the X-axis direction and in parallel with the Y-axis direction according to a profile of the tenons of the support bar; and a working device moved with the guide device, and including a blade extended downward in the Z-axis direction to contact the workpiece, so that the blade can cut mortises and tenons in the workpiece according to the profile and distance of the tenons of the support bar, wherein the guide device includes two axial displacement rods each mounted between the two side walls of the support base, a slide seat slidably mounted on the two axial displacement rods to move in parallel with the X-axis direction, two radial displacement rods each extended through the slide seat to move in parallel with the Y-axis direction, and a slide box fixed on the two radial displacement rods to move therewith.

5. The semi-automatic mortising machine in accordance with claim 4, wherein the guide device further includes an elastic member mounted between the slide seat and the slide box so that the slide box is constantly moved toward the support bar.

6. The semi-automatic mortising machine in accordance with claim 5, wherein the elastic member is a spring mounted between a side of the slide seat and a side of the slide box.

7. The semi-automatic mortising machine in accordance with claim 1, wherein the working device further includes a motor mounted on the guide device to rotate the blade.

8. The semi-automatic mortising machine in accordance with claim 4, further comprising a distance adjusting device including a support rack mounted on the slide box and directed toward the support bar, a molding bar extended through the support rack and in parallel with the Y-axis direction, and a threaded rod screwed on the support rack and in parallel with the Y-axis direction, wherein the molding bar has a first end formed with a molding end rested on the support bar and a second end formed with a locking end formed with a locking groove, the threaded rod has a bolt head locked in the locking groove of the molding bar, the threaded rod is moved relative to the support rack to move the molding bar so as to adjust a distance between the molding end of the molding bar and the support bar.

9. A semi-automatic mortising machine, comprising:

a support base including two side walls arranged in the X-axis direction, and at least one platform mounted between the two side walls for placing at least one workpiece;

a support bar mounted on the support base in parallel with the X-axis direction and having at least one side face formed with a plurality of tenons which are arranged in parallel with the X-axis direction;

a guide device mounted between the platform of the support base and the support bar and operated in a manual manner to displace in parallel with the X-axis direction and in parallel with the Y-axis direction according to a profile of the tenons of the support bar;

a working device moved with the guide device, and including a blade extended downward in the Z-axis direction to contact the workpiece, so that the blade can cut mortises and tenons in the workpiece according to the profile and distance of the tenons of the support bar;

a dust collection box secured on the guide device and having an inside formed with opening in parallel with the Y-axis direction and directed toward the blade, a top face provided with a transparent window, and a side formed with a chip drain hole.

* * * * *